US006131193A

United States Patent [19]

Bachner, Jr.

[11] Patent Number: 6,131,193

[45] Date of Patent: Oct. 17, 2000

[54] COMBINED PUNCTURE RESISTANT AND BALLISTIC RESISTANT PROTECTIVE GARMENT

[75] Inventor: Thomas E. Bachner, Jr., Eastport, Mich.

[73] Assignee: Second Chance Body Armor, Inc., Central Lake, Mich.

[21] Appl. No.: 09/031,025

[22] Filed: Feb. 26, 1998

Related U.S. Application Data

[62] Division of application No. 08/691,251, Aug. 2, 1996, Pat. No. 5,960,470.

[51] Int. Cl.[7] ..... F41H 1/02

[52] U.S. Cl. ..... 2/2.5

[58] Field of Search ..... 2/2.5, 102; 428/911; 89/36.5

[56] References Cited

U.S. PATENT DOCUMENTS

| | | | |
|---|---|---|---|
| 4,608,717 | 9/1986 | Dunbavand | 2/2.5 |
| 4,989,266 | 2/1991 | Borgese et al. | 2/2.5 |
| 5,327,811 | 7/1994 | Price et al. | 2/2.5 |
| 5,349,893 | 9/1994 | Dunn | 2/2.5 |
| 5,479,659 | 1/1996 | Bachner, Jr. | 2/2.5 |
| 5,565,264 | 10/1996 | Howland | 428/911 |
| 5,578,358 | 11/1996 | Foy et al. | 428/911 |
| 5,589,254 | 12/1996 | Dischler | 2/2.5 |
| 5,619,748 | 4/1997 | Nelson et al. | 2/2.5 |
| 5,622,771 | 4/1997 | Chiou et al. | 2/2.5 |
| 5,724,670 | 3/1998 | Price | 2/2.5 |

FOREIGN PATENT DOCUMENTS 0 197 278 10/1986 European Pat. Off. .

*Primary Examiner*—Michael A. Neas
*Attorney, Agent, or Firm*—Wildman, Harrold, Allen & Dixon; Thomas J. Ring

[57] ABSTRACT

A puncture resistant garment (20) which includes a plurality of flexible layers of woven sheets (22) positioned to overlie one another forming a puncture resistant panel (28), in which each of the plurality of woven sheets (22) is constructed of aramid fiber (24) and in which the woven sheets (22) have a weave of at least 60 said aramid fibers per inch in one direction and at least 60 said aramid fibers per inch in another direction transverse to the one direction. The aramid fiber (24) has at least one of the following characteristics of: a) the aramid fibers are constructed of filaments which provide from 50,000,000 up to 90,000,000 filament crossovers per square inch in each of the plurality of woven sheets (22), b) the aramid fibers provide greater than 3 per cent of break elongation and c) the aramid fiber provides greater than 23.8 grams per denier tenacity as well as securement for the plurality of layers of woven sheets (22) together to form the puncture resistant panel (28) which prevents puncture penetration from a sharp object (76) through the puncture resistant panel (20). Additionally, another embodiment includes a ballistic resistant panel (60) to overlie the puncture resistant panel (58) which is constructed of a woven fiber or a composite material (68) positioned to overlie the puncture resistant panel (64) to prevent penetration of a ballistic missile through the ballistic resistant panel (60, 64).

16 Claims, 6 Drawing Sheets

COMBINED PUNCTURE RESISTANT AND BALLISTIC RESISTANT PROTECTIVE GARMENT

This application is a divisional of application Ser. No. 08/691,251 filed Aug. 2, 1996, now U.S. Pat. No. 5,960,470.

BACKGROUND OF THE INVENTION

1. Field of the Invention

This invention relates to body protective garments and more particularly to protective garments which will protect a body from weapons which inflict puncture wounds and a testing method for such protective garments.

2. Description of the related art including information disclosed under 37 CPR 1.97–1.99

Various puncture resistant articles which are worn primarily by prison corrections officers and other types of security, military or law enforcement personnel are known to exist. Such puncture resistant articles are designed to prevent bodily penetration as a result of a stabbing or slashing from sharp objects or weapons. Unfortunately, these protective articles are generally rigid shields which are externally worn and are constructed of heavy, bulky and inflexible metal components such as titanium or other extremely hard metal alloys. The metallic composition of these cumbersome external vest shields must be of a sufficient thickness, rigidity and strength to stop impacts imparted by an attacker, such as a prison inmate, using a sharp knife, pick, shank or the like.

Disadvantageously, the bulk and rigidity of such metallic vest garments render it uncomfortable to wear. Furthermore, it is rather difficult for the wearer of a rigid vest such as a corrections officer to move and maneuver around quickly and easily which is important especially if the wearer is being attacked. The stiffness of these externally worn body shield vests are uncomfortable to wear in a sitting position since the lower edges often press firmly against the stomach, hip and side areas of the wearer, as well as, the top of the shield placing pressure on the wearer's throat and chin area. Moreover, the weight of such known metallic shields causes significant fatigue to the security personnel wearer over the time of the wearer's working shift. Accordingly, such known puncture resistant articles often prove to be ineffective predominantly due to the fact that the potential wearer prefers not to wear the bulky torso shield rather than tolerating its discomfort.

Another, and perhaps a more significant problem with such rigid metallic alloy puncture resistant vests is that they are not concealable. These known cumbersome shield vests are almost exclusively externally worn and even if they were not worn externally, the bulky nature of such articles make it obvious to a would be attacker that the wearer (corrections officer etc.) is wearing a protective puncture resistant metallic shield vest. Since the worn vest article cannot be concealed the potential attacker is more prone to stab or slash a vital area away from the vest such as the neck or head area. Not only is any element of surprise on the part of the wearer removed by the inconcealable nature of such cumbersome rigid vests, it is highly impractical if not impossible for undercover personnel to wear such bulky items.

These metallic alloy shield vest articles are primarily designed to bend or break the engaging sharp object such as a knife, shank or ice pick to prevent it from penetrating through the article. However, prison inmates unfortunately often make stiff-shafted awl-like weapons.

Certain known woven fabric garments such as the twelve ply polyester sail cloth PG-12™, produced by Second Chance Body Armor, Inc., have been produced for correctional use. However, such rigid and relatively heavy polyester sailcloth items have been shown to be rather stiff and boardy and therefore not highly conducive to wearabilty, concealment or comfort. Moreover, such sail cloth items have been shown to be limited in thrust resistant capabilities while also being relatively heavy, having weight of 0.80 pounds per square foot for a twelve ply PG-12™.

Certain externally worn bullet resistant articles which generally have limited capabilities against stabbing or slashing attacks are known. Such bullet resistant articles can be seen in U.S. Pat. No. 5,185,195 issued Feb. 9, 1993 to Harpell et al.; U.S. Pat. No. 5,196,252 issued Mar. 23, 1993 to Harpell; U.S. Pat. No. 5,198,280 issued Mar. 30, 1993 to Harpell et al.; U.S. Pat. No. 5,254,383 issued Oct. 19, 1993 to Harpell et al., and U.S. Pat. No. 2,316,820 issued May 31, 1994 to Harpell et al. Such articles primarily have layers of bullet resistant fibers which unfortunately are required to be stitched throughout the entire article with threads having a high tenacity. The laborious task of spacing the stitch less than one-eighth (⅛) of an inch apart from each other is required to be done throughout the entire article. A fibrous network on the article surface covers an underlying substrate composed of geometric planar rigid plates generally formed of a thermoplastic, ceramic or metallic composition. The geometric rigid plate-like bodies of the substrate are generally fastened or secured to the stitched fibrous outer cover layer. The thermoplastic, ceramic or metallic planar bodies in the substrate of the ballistic resistant article are secured along seams in an attempt to permit flexing of the substrate along the secured seams. The outer liner covering and the substrate layers containing the rigid plates generally require securement by horizontal and vertical stitching.

Certain standardized tests have been developed for testing the effectiveness of puncture resistant articles. One such standardized test is the California ice pick test, The State of California Specification 8470-8BS-001, para. 3.3, dated August 1988, which was developed to simulate the impact energy of a javelin. This test utilizes a standard 7 inch ice pick having a diameter of 0.163 inches attached to 16.2 pounds of weight which is dropped from 60.08 inches with the sharp end of the ice pick leading the impact into the underlying metallic vest article. While some metallic shields maybe capable of bending certain puncture weapons impacting with a force of approximately 81.1 foot-pounds, such known metallic vest shields generally might not stop stiffer shafted awls such as a Stanley® Tools scratch awl used under the California test at 81.1 foot-pounds.

In performing standardized tests for determining the level of protection for protective puncture resistant articles, a sharp weapon is dropped at a certain height with its sharp or pointed end making impact on the protective article being tested. The protective article being tested is supported by a hard firm base such as a block of clay material. This firm underlying support is rigid in nature and does not emulate the reaction of a human body which is more flexible with the capability to provide resilience in regaining shape and size after an impact or a blow. As a result, unrealistic results are often obtained with such resistant and rigid supports underlying the tested article the protective garment actually being worn on a more resilient human body. These inaccurate results, at times, lead to inaccurately designing of such protective articles. This may lead to adding greater weight and thickness in the article which, in turn, leads to increased discomfort by the wearer.

Under certain circumstances blocks of ordinance gelatin have been used as a tissue simulant for researching and studying ballistic injuries whereby bullets from firearms are shot into the gelatin blocks. See M. L. Fackler, M. D. and J. A. Malinowski, Ordinance Gelatin for Ballistic Studies, Detrimental Effect of Excess Heat Used in Gelatin Preparation, The American Journal of Forensic Medicine and Pathology, 9(3):218–219, 1988. However, preparation of such gelatin for ballistic research purposes is a precise process which is susceptible to temperature effects and is not used in association with testing puncture resistant materials or articles.

Flexible body armor such as bullet proof vests have been developed which are particularly suited to prevent bodily penetration from ballistic projectiles shot from firearms. Ballistic resistant garments constructed of layers of aramid fabric threads are generally known. Although, the construction of ballistic resistant materials are successful in preventing a projectile bullet from penetrating human tissue, such ballistic resistant body armor garments are not specially adapted for preventing punctures from sharp objects such as knifes, blades, ice picks, shanks, awls and the like. In particular, the weaves of the ballistic resistant fabrics used are generally too open for resisting an awl-like weapon attack. Moreover, the type of material and the combined arrangement thereof used in such bullet resistant articles have been shown to fall short of meeting adequate puncture resistant standards and further fail to provide the high tenacity and break elongation for resisting penetration of knife, shank or awl type weapons.

SUMMARY OF THE INVENTION

It is therefore a principal object of the present invention to provide a light weight flexible, concealable and wearable puncture resistant garment in which the disadvantages of known rigid puncture resistant articles and ballistic resistant articles are overcome.

It is therefore the object of this invention to provide a puncture resistant garment which includes a plurality of flexible layers of woven sheets positioned to overlie one another, in which each of the plurality of woven sheets is constructed of aramid fiber. Further in which, the woven sheets have a weave of at least 60 aramid fibers per inch in a direction and at least 60 aramid fibers per inch in another direction transverse to the direction. Moreover, the aramid fiber has at least one of the following characteristics a) the aramid fibers are constructed of filaments which provide from 50,000,000 up to 90,000,000 filament crossovers per square inch in each of the plurality of woven sheets, b) the aramid fibers provide greater than a 3 per cent of break elongation and c) the aramid fiber provides greater than 23.8 grams per denier tenacity. Additionally, securement is provided securing the plurality of layers of woven sheets together to form a panel which prevents puncture penetration from a sharp object through the panel.

It is a further object of the present invention to provide a puncture resistant garment which includes a plurality of flexible layers of woven sheets positioned to overlie one another forming a panel, in which each of the plurality of woven sheets is constructed of aramid fiber. Moreover, the woven sheets have a weave of at least 60 aramid fibers per inch in a direction and at least 60 aramid fibers per inch in another direction transverse to the direction. Additionally, the aramid fibers has at least one of the following characteristics a) the aramid fibers are constructed of filaments which provide from 50,000,000 up to 90,000,000 filament crossovers per square inch in each of the plurality of woven sheets, b) the aramid fibers provide greater than a 3 per cent of break elongation and c) the aramid fiber provides greater than 23.8 grams per denier tenacity preventing penetration of the panel with a sharp object. Additionally, a ballistic resistant panel constructed of at least one of a) woven fiber and b) composite material, positioned to overlie the panel to prevent penetration of a ballistic missile through the ballistic resistant panel.

It is a further object of the present invention to provide a method for testing a protective garment for puncture resistance, in which the method includes the steps of placing a protective garment to overlie a base constructed of ordinance gelatin and securing a sharp edged object to a weight. Additionally, the method includes positioning the sharp edged object secured to the weight a distance above the puncture resistant garment and releasing the sharp edged object secured to the weight to fall providing a sharp edge of the sharp edged object to impact the protective garment.

It is yet another object of the present invention to provide a method for assembling a puncture resistant garment including the steps of assembling a plurality of woven sheets constructed of aramid fibers to overlie one another in which each of the plurality of woven sheets is constructed of aramid fiber. Additionally, the invention provides the woven sheets have a weave of at least 60 aramid fibers per inch in a direction and at least 60 aramid fibers per inch in another direction transverse to the direction. Moreover, the invention provides the aramid fibers has at least one of the following characteristics a) the aramid fibers are constructed of filaments which provide from 50,000,000 up to 90,000,000 filament crossovers per square inch in each of the plurality of woven sheets, b) the aramid fibers provide greater than a 3 per cent of break elongation and c) the aramid fiber provides greater than 23.8 grams per denier tenacity preventing penetration of the panel with a sharp object. Further, the invention provides securement of the plurality of woven sheets together forming a puncture resistant panel.

BRIEF DESCRIPTION OF THE DRAWING

The foregoing objects and advantageous features of the invention will be explained in greater detail and others will be made apparent from the detailed description of the preferred embodiments of the present invention which is given reference to the several figures of the drawing, in which.

DETAILED DESCRIPTION

Figure 1A:
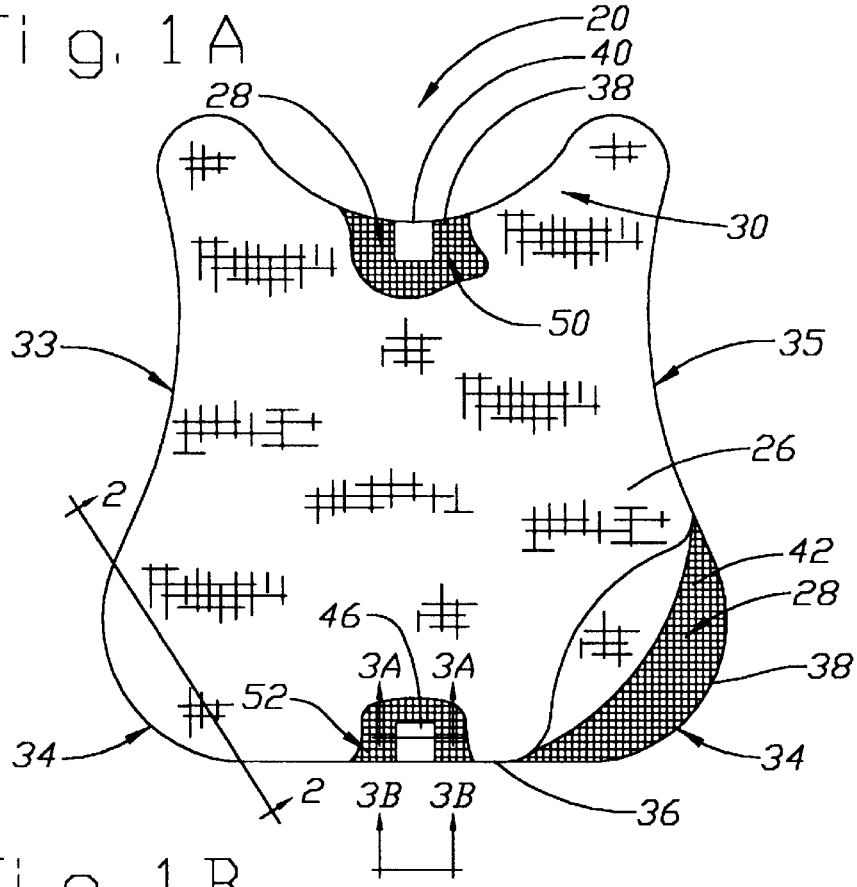
FIG. 1A is a front plan view of the puncture resistant garment with the cover sleeve of the puncture resistant garment partially broken away and pulled away.
Figure 1B:
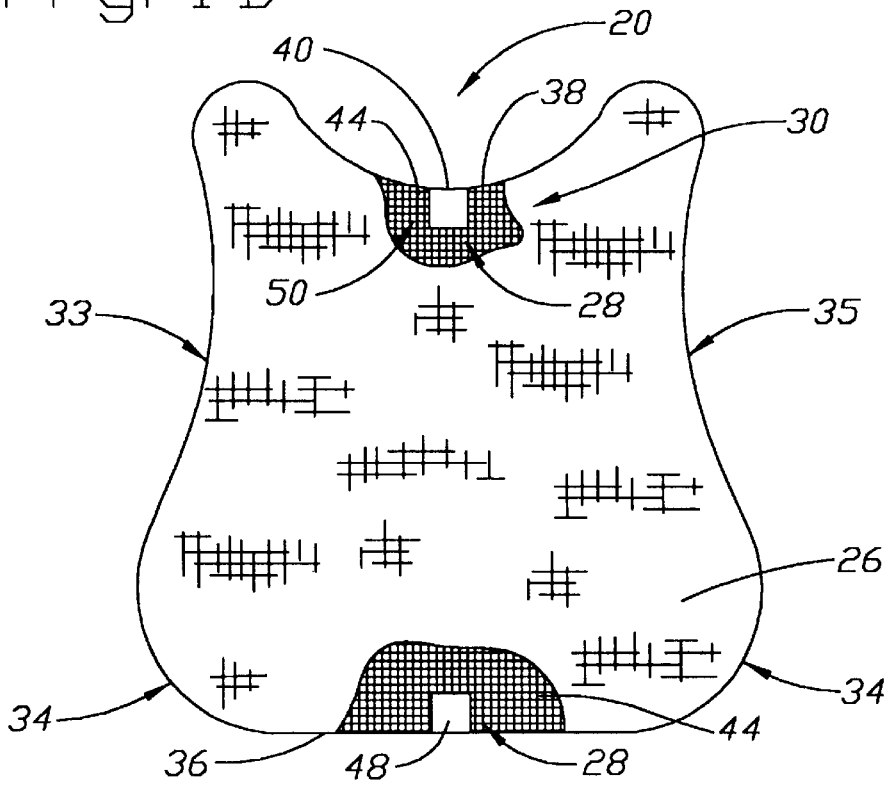
FIG. 1B is a back plan view of the puncture resistant garment shown in FIG. 1A with the cover sleeve partially broken away.
Figure 2:
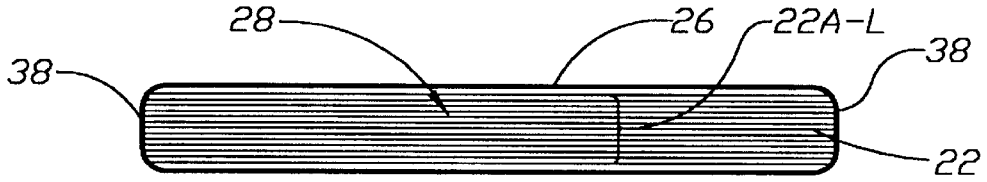
FIG. 2 is a cross section view taken along line 2—2 in FIG. 1A.

Referring now to FIGS. 1A, 1B and 2, a puncture resistant garment 20 having a plurality of layers of woven sheets 22 wherein each of the woven sheets is preferably constructed of an aramid fiber. In order to adequately protect the body of the wearer from an attempted puncture wound, the woven sheets 22 are formed of a sufficiently tight weave of at least sixty (60) aramid fibers per inch in one or a first direction and at least sixty (60) aramid fibers per inch in another crossing direction which is generally transverse to the first direction of aramid fibers. The tightly woven fibers are constructed of filaments which preferably provide from (50,000,000) fifty million filament crossovers per square inch up to (90,000,000) ninety million filament crossovers per square inch in each of the individual woven sheets 22 in the puncture resistant garment 20. Crossover calculations are derived by multiplying the number of filaments in a fiber times the number of fibers per inch in the weave in the first direction and then multiplying that amount by the number of filaments in a crossing fiber times the number of the crossing fibers per inch in the weave in the other or crossing direction. This range of filament crossovers is generally significantly below what is utilized in ballistic resistant weaves. Lower crossover numbers are utilized in the present invention for repelling and trapping hand driven sharp objects such as knives, awls, shanks and the like, unlike, the much higher crossover numbers which are employed to stop the sheer force of a highly energized bullet.

Figure 7A:
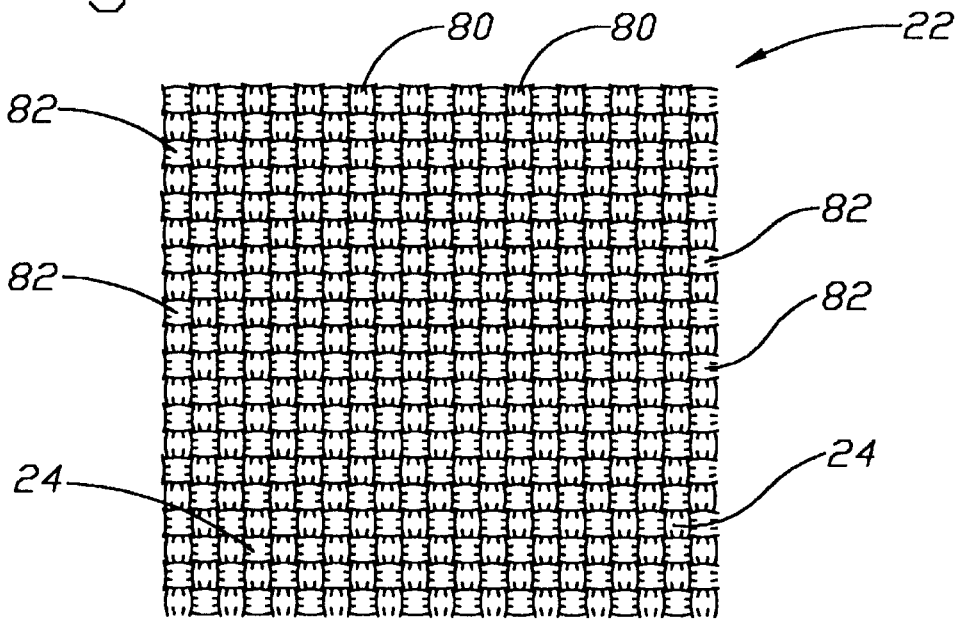
FIG. 7A is an enlarged partial view representative of the weave of a woven sheet of aramid fibers for the puncture resistant panel of the garment depicting a balanced weave.
Figure 7B:
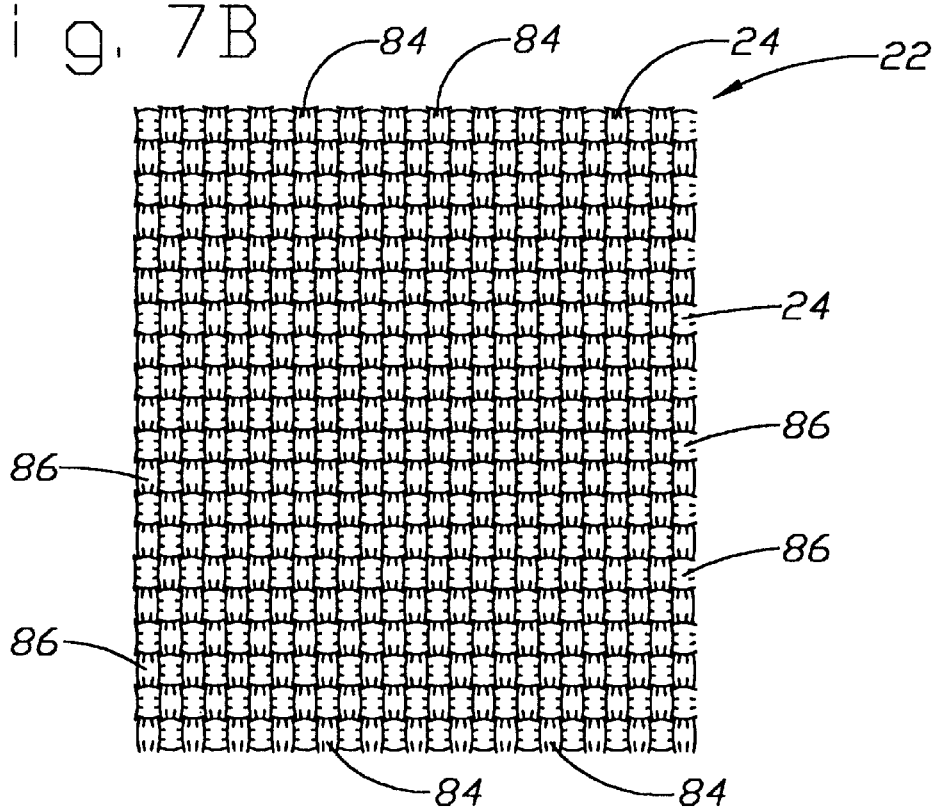
FIG. 7B is an enlarged partial view representative of the weave of a woven sheet of aramid fibers for the puncture resistant panel of the garment depicting an imbalanced weave.

The woven aramid fibers 24, as seen in FIGS. 7A and 7B, also provide greater than (3.0%) three percent of break elongation which indicates the length the material will elongate before it breaks. This greater than three percent amount for break elongation indicates the fiber 24 employed in forming the woven sheets 22 is capable of deforming with the imparting of energy from the impact of a sharp object facilitating slowing, inhibiting and trapping the sharp object in preventing puncture penetration. Preferably, the aramid fibers 24 FIGS. 7A, 7B, woven into layered flexible sheets 22 provide greater than 23.8 grams per denier tenacity. This is a significantly high tenacity whereby a high tenacity in combination with a high break to elongation provides the relatively increased toughness of the fiber which has been shown to be key aspect of the present invention when engaging sharp objects that are thrusted at the wearer.

In the preferred embodiment, the aramid fibers 24 are at least 200 denier and have break elongation of 3.45 per cent (3.45%) and tenacity of at least 27.0 grams per denier and a modulus of 730 grams per denier. Aramid fibers constructed of Kevlar® 159, manufactured by DuPont Corporation, of Wilmington, Del. are preferably used to be woven into a 70 fiber per inch×70 fiber per inch weave forming the aforementioned sheets 22. An individually layered woven sheet 22 preferably employed has a weight of approximately 3.8 ounces per square yard and a thickness of only 0.007 inches (7 mils). The relative thin and lightweight properties of the present invention promote the benefits of wearability and concealability. In order to provide sufficient penetration resistance from knives, blades, shanks, stiff shafted awls and the like it has been found that the aramid fibers of Kevlar® 159 must be woven together into a formed sheet such that the weave is at least 60 fibers per inch in one direction and at least 60 fibers per inch in another transverse direction.

As seen in FIGS. 1A, 1B and 2, the layers of flexible woven sheets 22 are housed by a flexible sleeve 26 which is constructed of a moisture vapor permeable and water proof material such as Gore-tex®, also known as Windstopper™, manufactured by W. L. Gore & Associates, Inc. of Newark, Del. This sleeve covering 26 of the present invention provides the garment with the desired breathability and alleviating the degrading aspects of contaminants such as body oils and salts, fuel spills, soaps, detergents, urine and blood and other undesirable contaminants to internal portions of the garment. The puncture resistant garment 20 including the outer moisture vapor permeable and waterproof cover or sleeve 26 as well as the flexible panel 28 of the layered woven sheets 22 is sized and shaped to accommodate the covering of a chest area and an abdominal region of the wearer. Alternatively, it is contemplated in the present invention to employ other outer covers, such as those formed of polyester, nylon and like materials, as well as employing no covers at all based on the particular needs of the wearer. A top portion 30 of the puncture resistant panel 28 of woven sheets 22 generally defines a U-shaped recess for receiving a lower portion of the neck of the potential wearer. The side portions 33, 35 of puncture resistant garment 20 having the flexible sheets 22 of finely woven aramid fibers 24 are generally tapered inwardly to permit movement of the wearer's arms and for added comfort. The bottom corner edges 34 of the puncture resistant garment 20 are rounded with the central portion of the garment bottom 36 generally being straight and flat. As seen in FIG. 1A, the puncture resistant panel 28 comprised of layers, FIG. 2 of the flexible woven aramid fiber sheets 22 is shaped to be substantially congruent to the shape of the Gore-tex™ sleeve 26 covering the panel 28 of sheets 22. The shape of the outer edges 38 of the plurality of woven sheets are each congruent with each other as they are positioned in a layered fashion to lie upon each other within the panel 28.

Figure 3A:
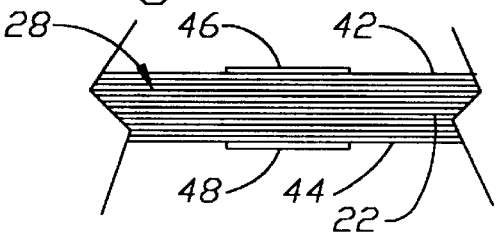
FIG. 3A is a cross section view taken along line 3A—3A in FIG. 1A.
Figure 3B:
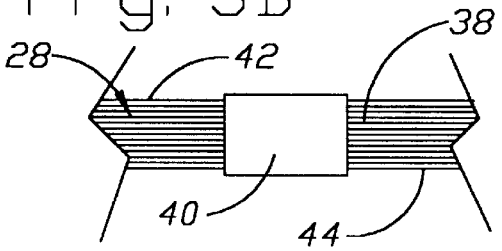
FIG. 3B is an end view taken along line 3B—3B in FIG. 1A.

As seen in FIGS. 1A, 1B, 3A and 3B, the plurality of flexible layers of the woven sheets 22 are preferably non-invasively secured to form the puncture resistant panel 28 of such layered sheets. Noninvasively securing the woven sheets 22A–L, FIG. 2, together aids in preventing puncture penetration of a sharp object through the panel 28. Noninvasive securing in the present invention avoids employing an opening through the panel as opposed to securement through stapling or the like which establishes an open path of lesser resistance for stopping penetration by a sharp object. In the preferred embodiment, noninvasive securement of the twelve layers of woven sheets 22A–L, FIG. 2, is suitably accomplished by placing a piece of tape 40 around the top sheet 42 and over the bottom sheet 44 in the panel 28 as seen in FIGS. 3A–3B. As seen in FIGS. 1A and 3A a portion 46 of the securement tape 40 secures a top surface of the top sheet 42 in the panel 28 of sheets 22 and another portion 48 of the tape 40 secures to a bottom sheet 44 (See FIG. 1B) of the panel in order to noninvasively secure the plurality of woven sheets together.

As best seen in FIG. 3B, the securement tape 40 secures each of the adjacent edges of the layered woven sheets 22. As seen in FIGS. 1A, 1B and 3B, the securement tape 40 secures the edges of the woven sheets 22 at a top location 50 on one side edge of the panel 28 while another piece of the securement tape 40 secures the edges of the layered puncture resistant sheets 22 at another or bottom location 52 on another or bottom side edge of the panel. The pieces of securement tape 40 secure the one and the other side edges, preferably top and bottom side edges, of the panel 28 which are positioned on opposing sides of each other on the puncture resistant panel 28.

An alternative approach to securing the layers of woven sheets 22 together in a principally noninvasive manner may be accomplished by positioning an adhesive to be placed between adjacent of various woven sheets of aramid fibers. It is also contemplated in the present invention that other various approaches to securing or maintaining the alignment of the woven sheets 22 may be accomplished such as through the employment of external clips pinching the layered sheets, lamination along top and/or bottom edges of the sheets or gluing the sheets at preselected locations along the sheet edges.

Referring now to FIG. 2, the panel 28 preferably contains twelve (12) individually layered sheets, (illustrated as 22A–L FIG. 2) of the finely woven aramid fibers 24, FIGS. 7A, 7B. In accordance with the present invention, fewer of the layered sheets can be suitably employed, wherein at least eight (8) individually layered sheets 22 are generally used to form a puncture resistant panel. Differing numbers of total sheets per panel and differing numbers of panels or sub-panels used for individual puncture resistant garment vests may be suitably employed in accordance with user requirements or desired levels of protection, flexibility and comfort. Securement or aligning and positioning of the woven sheets 22 may also be accomplished by means of the outer sleeve 26 encasing the sheets to form the puncture resistant panel 28. As discussed above, the outermost covering sleeve 26 of the preferred embodiment is substantially congruent and the same shape as the individual sheets 22 in order to create a tight pit and to position the sheets into proper alignment for forming the puncture resistant panel. As seen in FIG. 2, it is desired to have tight fit of the Gore-tex® sleeve 26 about the panel of flexible layered sheets 22 such that the outer edges 38 of the panel 28 are in close proximity within one half inch or less, or are in actual abutment with an inside edge of the sleeve 26. This maintains the woven sheets in proper alignment and prevents sliding movement of individual sheets upon engagement with a sharp knife, awl, ice pick or other sharp object.

Figure 4:
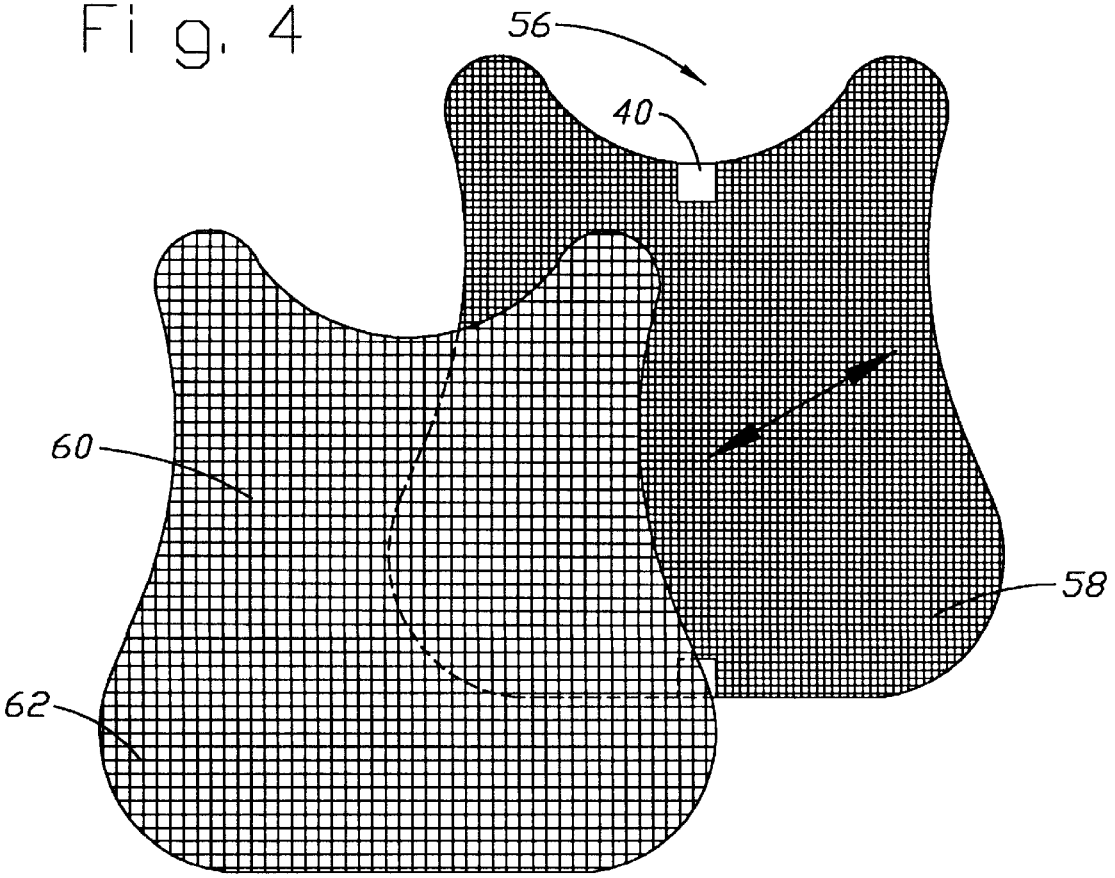
FIG. 4 is an exploded view of another embodiment of the present invention in which a hybrid garment of a ballistic resistant panel overlies a puncture resistant panel.

Referring now to FIG. 4, an alternative embodiment of a puncture resistant garment 56 and a preferred embodiment of a hybrid or combination puncture resistant and ballistic resistant garment which is shown having an inner puncture resistant panel 58 of layered sheets of woven aramid fibers as described in FIGS. 1A–3B, and an outer ballistic resistant panel 60. The puncture resistant panel 58, seen in FIG. 4, is preferably of the same layer orientation, dimension, material and weave construction as puncture resistant panel 28 described herein with reference to FIGS. 1A–3B. The ballistic resistant panel 60 is positioned at the front or outer area of the composite ballistic and puncture resistant garment 56 relative to the wearer of the garment. As seen in FIG. 4, the ballistic resistant panel 60 is positioned in front of the puncture resistant panel 58 at the strike face of the vest garment 56. The ballistic resistant panel 60 is placed to the front of the garment 56 and away from the body of the wearer relative to the inner puncture resistant panel 58 such that an attacking object eg. projectile, sharp weapons etc. would initially contact the outer ballistic panel 60. Individual outer covers for each of the ballistic resistant and puncture resistant panels as is shown in FIG. 4 is generally not imperative to provide proper protection, thus, it is often preferred that individual puncture resistant panels and ballistic resistant panels are placed in aligned overlying position with a single outer sleeve covering both panels.

In the embodiment shown in FIG. 4, the ballistic resistant panel 60 is constructed of a plurality of individual sheets in which the individual sheets are constructed of woven fibers 62. However, unlike the weave in the plurality of sheets 22 in the puncture resistant panel 56, in order to provide ballistic protection the ballistic resistant panel 60 is formed of flexible layered sheets of a woven fiber having significantly less than sixty (60) warp ends per inch and less than sixty (60) fill ends per inch. The warp ends represent the aramid fibers which extend along the length of the fabric and the fill ends are representative of the other fibers of the weave which are woven in generally a transverse direction to the warp ends. The sheets of the ballistic resistant panel 60 of the preferred embodiment are formed of a woven aramid fiber, however ballistic aramid fibers are constructed of filaments having much greater than 90,000,000 filament crossovers per square inch.

The structural characteristics of the ballistic resistant panel 60 render it suitable for stopping penetration of a projectile object such as a bullet shot from a firearm. Such characteristics differ from the novel structural characteristics of fiber weave properties combined with particular fiber strength, fiber compound, filament crossover range, break elongation percentage, denier, tenacity and strength described above for the puncture resistant panel whereby such combination enables the puncture resistant panel 28, 58 to protect against and prevent penetration from various knives, blades, shanks, awls and other sharp objects. The ballistic resistant panel 60 in the embodiment shown in FIG. 4 is formed of sheets of woven aramid fibers of preferably greater than 200 denier. The woven sheets preferably are formed of aramid Kevlar® fibers in the ballistic resistant panel such as Nos. 29, 49, 129 and 149. Other fibers used in forming ballistic resistant fabrics include Twaron® T-1000 and T-2000 made by AKZO NOBEL, Inc. and Spectra® woven fabrics manufactured by Allied Signal, Inc. Many types of fibers are available for this ballistic resistant construction which includes polyethylene fibers. Moreover, there have been generations of fibers and fabrics made from these fibers which have evolved over the years beginning with the first generation of ballistic nylon; second generation of Kevlar® 29, Kevlar® 49, Twaron and Spectra®; third generation of Twaron T-2000 Microfilament, Kevlar® 129 and Kevlar® LT fabrics; and fourth generation of Araflex™. Numerous fibers are known to be suitable and are used in the construction of woven ballistic resistant garments. Such a ballistic resistant panel can be seen in U.S. Pat. No. 5,479,659 entitled "Lightweight Ballistic Resistant Garments and Method to Produce Same" issued Jan. 2, 1996 to Bachner and is herein incorporated by reference. Such a garment would preferably have an imbalanced weave of twenty-two by twenty-four fibers per inch and would utilize Kevlar® which would provide between 100,000,000 to 275,000,000 crossovers.

Figure 5:
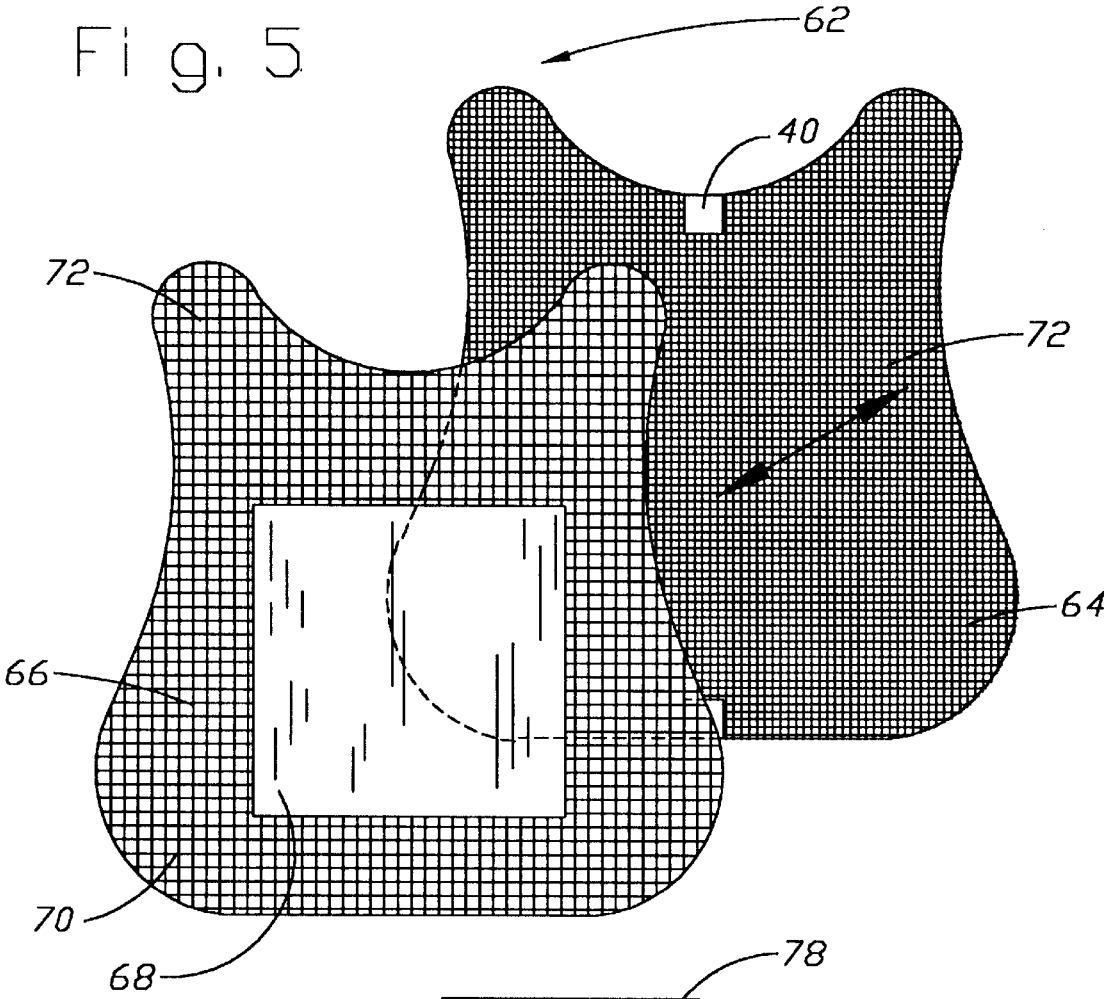
FIG. 5 is another embodiment of a ballistic resistant panel overlying the puncture resistant panel of FIGS. 1A and 1B.

Referring now to FIG. 5, an alternative embodiment 62 to the hybrid or combination protective garment which includes a puncture resistant panel 64 and ballistic resistant panel 66 is shown. In the embodiment seen in FIG. 5, an alternative composite material 68 for the ballistic resistant portion of the vest overlies the puncture resistant panel 64 in order to prevent penetration of a ballistic missile or projectile through the ballistic resistant panel 66 positioned in front of the underlying puncture resistant panel 64. The ballistic resistant panel 66 of FIG. 5 is constructed of the relatively looser woven Kevlar® aramid fiber having the properties as described with reference to FIG. 4. The composite material 68 for the ballistic resistant panel portion shown in the embodiment in FIG. 5 also includes a metallic sheet member 68 centrally positioned either at the frontal strike face area of the garment 62 or disposed within the layered ballistic sheets of the ballistic resistant panel 66. Preferably, the composite material or sheet 68 is formed of a metal such as titanium or other suitable very strong metals, as well as, other suitable composite materials that are ballistic resistant such as ceramics, or Spectra Shield®, Gold Shield® and Gold Flex® as well as other reinforced plastics manufactured by Allied Signal Inc. of Morris County, N.J., and other nonwoven composite materials and the like. These ballistic resistant materials woven and nonwoven (composite material) are used in the present invention either separately or individually with the puncture resistant panel or in combination with each other and the puncture resistant panel. Numerous ballistic resistant panels have been developed utilizing woven aramid fibers or other comparable performance fibers, as well as, composite materials or both which are selectively used in this embodiment for panel 66.

The hybrid vest or combination puncture resistant garment 62 having added ballistic resistant capabilities in the embodiments of FIGS. 4 and 5 are shown without a sleeve or Gore-tex® type cover for the individual puncture resistant panel 66 and the ballistic resistant panel 66. This was shown without a sleeve covering as shown in FIGS. 4 and 5 to illustrate the weaves of the particular embodiments and it is, of course, contemplated by the applicant that a single sleeve (preferably Gore-tex® cover) would contain both the ballistic resistant panel 66 and the distinct puncture resistant panel 64 together placed therein. The single sleeve covering, accordingly, has an interior region having substantially the same shape and configuration of the ballistic resistant vest panel 66 and puncture resistant vest panel 64, which are substantially congruent having substantially the same shape to each other. The hybrid garment of the present invention having a ballistic resistant panel positioned at a strike face region in front of and overlying the combined puncture resistant panel described in FIGS. 4 and 5, has been shown to have complimentary capabilities whereby the puncture resistant panel has limited ballistic resistant capabilities and the ballistic resistant panel has certain capabilities in protecting against broad blade slashing and cutting.

Figure 6:
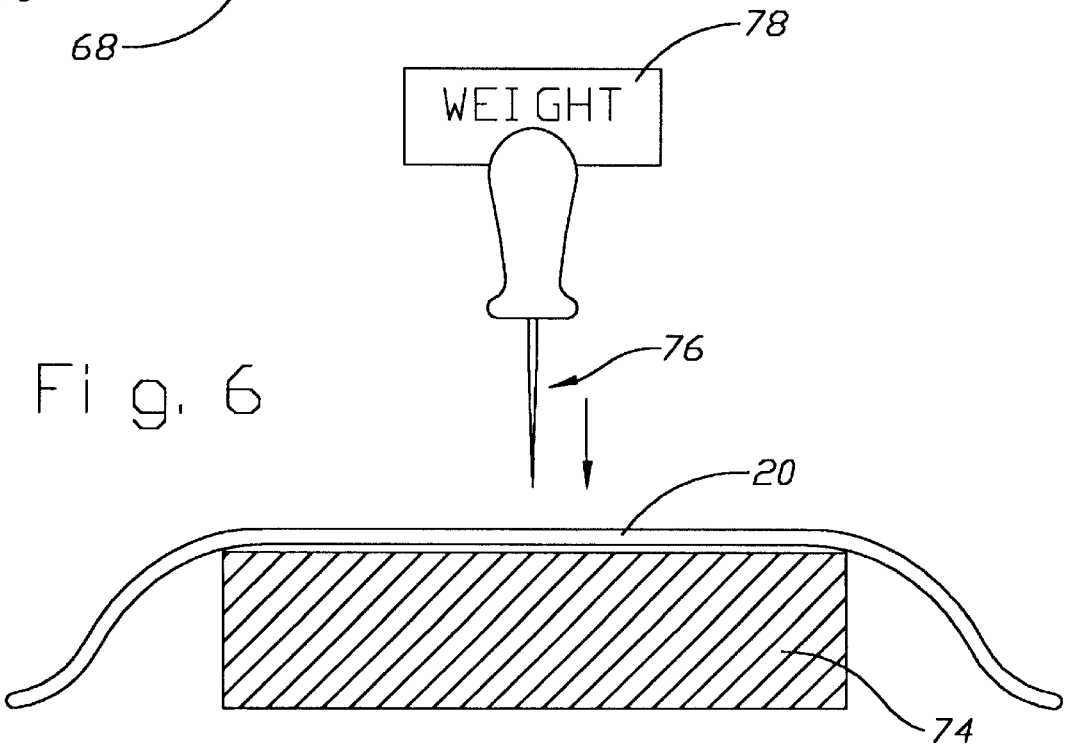
FIG. 6 is a side elevation view of the testing operation of the present invention.

Referring now to FIG. 6, a side elevational view representative of a testing operation for a puncture resistant garment 20 of the present invention is shown with a base of ordinance gelatin 74 underlying the protective puncture resistant garment 20 to be tested. A sharp edged object 76 such as a knife, shank, ice pick, awl or the like is initially positioned at a preselected height and is associated with or attached to a weighted object 78 or weighted apparatus to guide the weighted object having a preselected weight. Once the initial set up is accomplished, the sharp edged object 76 secured to the weight 78, which is initially held into position by a brace or other suitable guiding means at a particular height, is dropped or released, thereby enabling the weighted object 78 to fall whereby the sharp edged object 76 impacts with the protective garment 20 being tested. The ordinance gelatin base 74 is formed to a composition to emulate a resilient reaction of a human torso thereby providing realistic and accurate test results for the protective garment 20 or puncture resistant panel 28 overlying the ordinance gelatin base 74. The impact of the sharp edged object 76 upon the protective garment 20 will cause garment 20 to resiliently move and respond to the forces impacting thereon.

The underlying ordinance gelatin 74 provides for realistic testing of puncture resistant items under various tests including the California ice pick test. Such testing was carried out in accordance with The State of California Specification 8470-8BS-001, para. 3.3, dated August 1988. The test samples selectively are impacted with an ice pick 7" long by 0.163" in diameter having a hardness of RC-44, weighed to 16.20 pounds and dropped from a height of 60.08 inches. This California ice pick test utilizes a firm clay base which is less resilient than the gelatin base 74 of the present invention and is less representative of a human body than the gelatin. This firmer clay base results in the protective garment incurring relatively higher shear from a given impact from a sharp object than if the same protective garment was overlying the gelatin base of the present invention which is more resilient. Thus, the clay base provides more conservative and lower results potentially leading to even thicker and more bulky protective garments than if the more realistic gelatin base of the present invention was used.

The puncture resistant panel 28 described herein with reference to FIGS. 1A–3B and FIGS. 7A, 7B, 8 and 9 has been tested using the parameters of the California ice pick test while employing an ordinance gelatin backing to generate results resembling actual field performance. With a puncture resistant panel 28, having the weave and composition described herein, with thirty-two (32) woven sheets of the aramid fiber segmented into sub-panels (See FIG. 8), the flexible and concealable puncture resistant garment of the present invention has been shown to withstand the California ice pick test using an ice pick and a stiff shafted Stanley® tools awl, model 69-122, at 81.1 foot-pounds. Additionally, it has been shown that the puncture resistant panel 28 of the present invention has been able to withstand such an ice pick at 81.1 foot pounds for the California ice pick test using an ordinance gelatin backing in which as few as twenty-eight (28) layered sheets of 70 fibers per inch×70 fiber per inch woven fabric are employed in the panel.

The puncture resistant garment of the present invention due to the combination of its weave with the woven fiber composition, properties and characteristics described herein as well as the arrangement and securement of the woven sheets in forming various puncture resistant panels and sub-panels, provides optimum protection against stabbings, slashings and the like at various protection levels while being flexible, lightweight, wearable, breathable and concealable. The weight and thickness of the protective puncture resistant garment of the present invention may selectively vary depending on the desired level of protection. A puncture resistant garment 20 of the present invention having approximately twelve (12) woven sheets in a panel 28 as seen in FIG. 2, has been shown to provide protection against an awl at thirty-nine (39) foot-pounds; an ice pick at forty (40) foot-pounds and a boning knife at ten (10) foot-pounds, in which the garment 20 tested has a weight of only 0.32 pounds per square foot and a thickness of only 0.08 inches. The results were performed on the puncture resistant garments of the present invention having a balanced weave of 70 by 70 aramid fibers per inch and employing Kevlar® 159. A garment employing twenty-two (22) woven sheets of such aramid material weighing 0.58 pounds per square foot and having a thickness of only 0.17 inches has been shown to stop an awl at seventy-one (71) foot pounds, an ice pick at seventy-four (74) foot-pounds and a boning knife at eighteen (18) foot-pounds. The garment of the present invention when employing thirty-two (32), FIG. 8, sheets of the aramid Kevlar® 159 material woven at a 70 by 70 fibers per inch weave and having a total weight of approximately 0.84 pounds per square foot and a thickness of approximately 0.25 inches was shown to stop an awl at 81.1 foot-pounds, an ice pick at 81.1 foot-pounds and a boning knife at twenty-six (26) foot-pounds.

In accordance with the present invention a method of testing the puncture resistance of a protective garment involves the steps of (1) placing the protective garment 20 or puncture resistant panel 28 to overlie a base 74 constructed of ordinance gelatin; (2) securing a sharp edged object 76 to a weight 78; (3) positioning the sharp edged object 76 secured to the weight 78 at a distance above the puncture resistant garment 20; and (4) releasing the sharp edged object 76 secured to the weight 78 to fall providing a sharp edge of the sharp edged object 76 to impact the protective garment 20 enabling the ordinance gelatin base 74 underlying the protective garment 20 to resiliently move and respond to the impact from the sharp edged object 76 impacting onto the protective garment 20.

The preferred method includes the step of positioning the protective garment 20 to lie substantially flat over the base of ordinance gelatin 74. The garment 20 having a single preselected thickness is positioned over the ordinance gelatin base 74 to receive the impact of the free falling knife, shank, ice pick, awl or other sharp object 76. The weight attached to the sharp object 76 is generally at least 16.0 pounds and is dropped with the object at a preselected height of approximately 5.0 feet. The ordinance gelatin used in employing the method of testing is preferably a Knox type 250A gelatin, however other suitable gelatin types may be used. The block of ordinance gelatin 74 used as the base to simulate actual performance for testings of the overlying vest 20 is constructed of a solution of the dehydrated Knox 250A gelatin which is mixed with water. The solution of dehydrated gelatin and water is first initially cooled down prior to elevating its temperature and stirring it. The mixed solution is then heated to elevate the temperature and the solution is stirred during preparation. The solution is subsequently cooled for 24 hours until it solidifies and thickens. Fractures in the newly formed gelatin block are then repaired to reuse the base 74 reheating the gelatine and mixing more solution into the existing solution and resolidifying the base 74. The gelatin base 74 is formed into a block which is approximately four (4) inches in thickness, however the block may selectively be formed at a larger thickness. It is desirable to form the gelatin base 74 in such a manner as to have a top surface or strike face region on the gelatin base 74 which have dimensions of at least six (6) inches×six (6) inches in area and thus, a suitable container to enable the forming of the base having such dimensions is employed when solidifying the ordinance gelatin.

Referring now to FIG. 7A, an enlarged view representative of a balanced weave for one of the plurality of woven sheets 22 of aramid fibers in the puncture resistant panel 28. The weave is balanced as shown in FIG. 7A, since the number of warp ends 80 of the aramid fibers 24 placed in a direction along the length of the fabric sheet matches the same number of fill ends 82 of the aramid fibers which run in a transverse direction to the warp ends. The weave of the puncture resistant layered sheets contains at least 60 warp end aramid fibers per inch across the length of the fabric sheet 22 and at least 60 fill end aramid fibers per inch intersecting with the warp ends. Preferably, a 70 fibers per inch warp end×70 fibers per inch fill end weave is employed in the individually woven sheets 22 of aramid fibers described in FIGS. 1A, 1B and 7A. Each individual woven sheet 22 preferably used has a weight of approximately 3.8 ounces per square yard and has a thickness of only 0.007 inches (7 mils).

An alternative weave arrangement for the puncture resistant layered woven sheets 22 of aramid fibers 24 is shown in FIG. 7B, in which the warp ends 84 and fill ends 86 of the aramid fibers are imbalanced in number. In the weave arrangement of FIG. 7B, the number of warp ends 84 per given length (inch) of the aramid fibers is greater than the number of fill ends 86 for the same given length (inch). As seen in FIG. 7B, the imbalanced weave has more warp ends 84 extending along the length of the sheet 22 fabric than fill ends 86 weaved across the warp ends.

The material used to enable the 70×70 aramid fibers per inch weave described in FIG. 7A and also used in the imbalanced weave of FIG. 7B preferably is Kevlar® 159 developed by DuPont Company, of Wilmington, Del. Kevlar® 159,200 denier, has a break elongation of 3.45%, a filament crossovers (134 filaments for a 70×70 weave) of just over 87,000,000 and has a tenacity of 27.0 grams per denier. The modulus of the fiber preferably employed in the present invention is 730 grams/denier. Other suitable aramid fibers may selectively be used to enable an acceptable weave for proper puncture resistance wherein such aramid fibers are at least 200 denier, have a break elongation of at least 3.45% and have a tenacity of at least 27.0 grams per denier.

Figure 8:
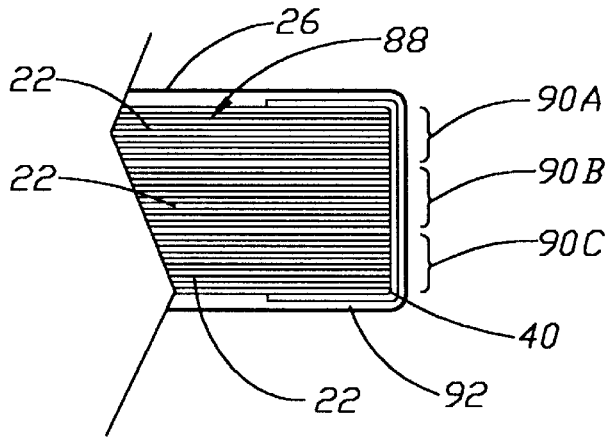
FIG. 8 is an enlarged cross section view as seen along line 8—8 in FIG. 10 depicting sub-panels of the puncture resistant garment.

Referring now to FIG. 8, a sectional side view of an embodiment of the invention illustrating a puncture resistant panel 88 being comprised of three individual sub-panels 90*a*, 90*b*, and 90*c*. In each sub-panel 90*a*, 90*b*, 90*c*, less than the total number of woven sheets 22 are minimally secured together thereby forming the sub-panel. The puncture resistant panel 28 depicted in FIG. 8, has a total thirty-two (32) sheets 22 of woven aramid fibers. The panel 88 is segmented into three sub-panels 90*a*, 90*b*, and 90*c*. Top sub-panel 90*a* has ten layered sheets formed of woven Kevlar® 159 fibers which are stitched together, central sub-panel 90*b* has twelve (12) sheets of woven fibers stitched to form the sub-panel, and bottom sub-panel 90*c* also has ten (10) sheets of woven fabric which are stitched at preselected locations to form the bottom sub-panel. The three sub-panels 90*a*, 90*b*, and 90*c* depicted in FIG. 8, are noninvasively secured together by tape 40 in order to prevent sliding movement of the sub-panels. The securing tape 40 is adhered onto a portion of the top sheet of the top sub-panel, is extended to and adheres to the side edge of each sub-panel 90*a*, 90*b*, and 90*c* comprising the puncture resistant panel 88 and is also adhered to the bottom sub-panel at a corresponding bottom portion of the bottom puncture resistant woven sheet of bottom sub-panel 90*c*. The outer covering sleeve 92 is snugly positioned about the noninvasively secured sub-panels 90*a–c*.

Figure 9:
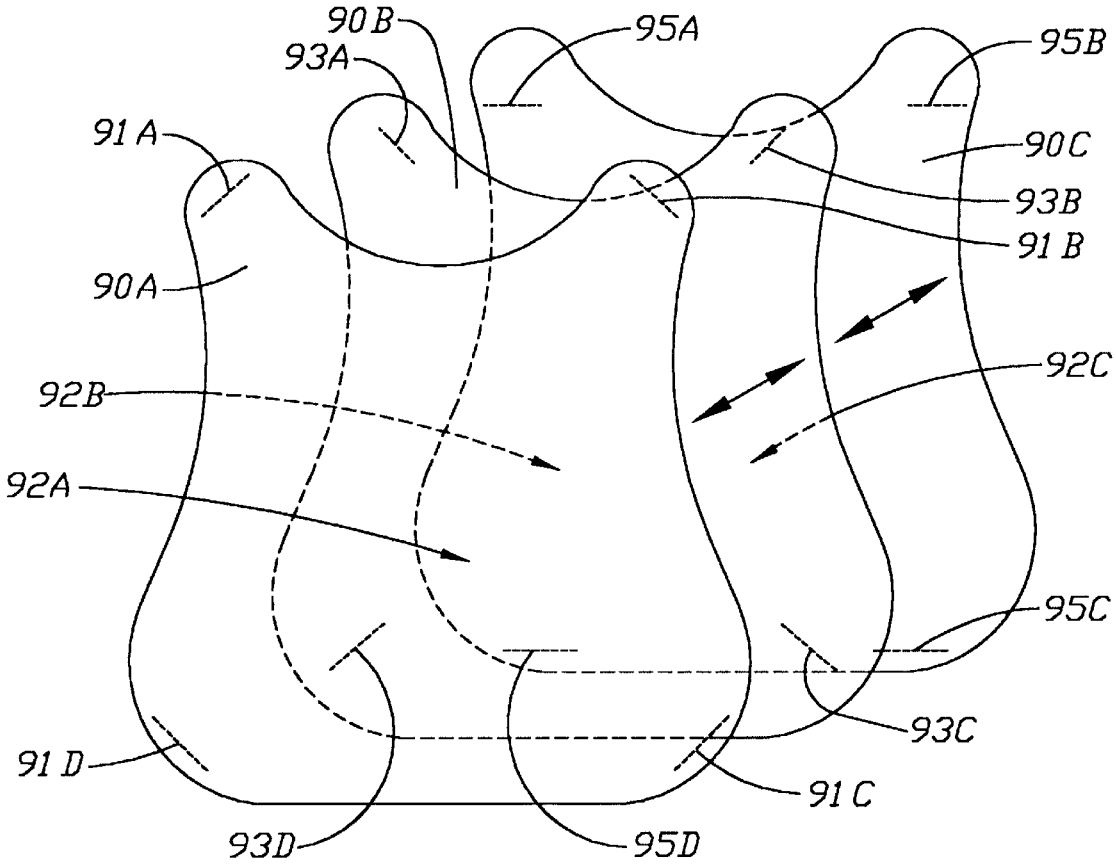
FIG. 9 is an exploded schematic representational view of uncovered sub-panels of the puncture resistant garment used to depict the stitching patterns for the puncture resistant sub-panels with the weave patterns removed from the sub-panels.

Referring now to FIG. 9, an exploded and partially schematic view of the puncture resistant garment of the present invention is shown having three sub-panels 90*a*, 90*b* and 90*c,* in which the woven fiber sheets for each individual sub-panel are secured together by stitches of a suitable aramid fiber in order to form the distinctly identifiable sub-panel. The stitches employed are made of a sufficiently strong fibrous material to secure and maintain the proper aligned positioning of the overlying congruently shaped woven sheets. The aramid fiber employed for such stitching in the present invention preferably is constructed of a Kevlar® material. Each of the individual sub-panels 90*a,* 90*b,* and 90*c,* has its puncture resistant woven sheets invasively secured together by four separate lines of stitches. The lines of stitches are each positioned in a lower right, lower left, upper right and upper left corner portion relative to the center or central portion of the respective sub-panel for the puncture resistant vest garment. Top sub-panel 90*a* as seen in FIG. 9, is secured by four lines of stitches 91*a,* 91*b,* 91*c* and 91*d,* the woven sheets of central sub-panel 90*b* are invasively secured together by stitches 93*a,* 93*b,* 93*c* and 93*d* and bottom sub-panel 90*c* its puncture resistant sheets are secured by stitches 95*a,* 95*b,* 95*c* and 95*d.*

For illustrative purposes FIG. 9, is representative of a puncture resistant panel with the outer covering sleeve removed and is exploded into the three sub-panels 90*a,* 90*b* and 90*c.* Additionally, in FIG. 9 the tight weave of the aramid fibrous sheets was not emphasized, in an effort to better show the stitching and its relative positioning on the sub-panels 90*a*, 90*b* and 90*c.* Of course, as previously described, the minimal stitching for the sub-panels directly secures the woven aramid fibrous sheets into forming the identified sub-panels. Each line of the stitches for each sub-panel 90*a–c* are spaced apart from the edge of their respective sub-panel, but are also positioned in the four corners of the sub-panel closer in distance to the respective edge than to the central portion 92*a,* 92*b* and 92*c* of the sheets which they secure, beneath the overlying cover sleeve as seen in FIG. 10.

Figure 10:
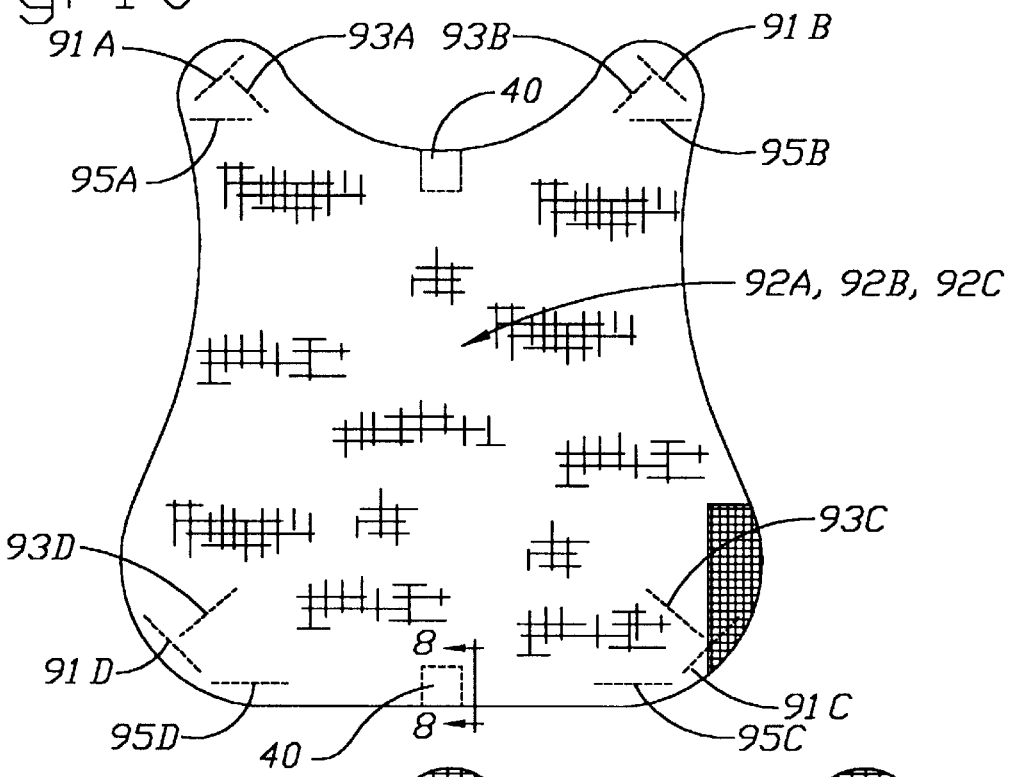
FIG. 10 is a front representation of a plan view of the assembled puncture resistant sub-panels as seen in FIG. 9 with a sleeve encasing the sub-panels and depicting stitching arrangements for each sub-panel beneath the covering sleeve.

Referring now to FIG. 10, the sub-panels 90*a,* 90*b* and 90*c* formed of stitched sheets of woven aramid fibrous material described in FIG. 9, are shown in an assembled position depicting the stitching for each of the overlying sub-panels. The stitches 91*a,* 91*b,* 91*c* and 91*d* of sub panel 90*a,* and the stitches 93*a,* 93*b,* 93*c* and 93*d* of sub-panel 90*b,* as well as the stitches 95*a,* 95*b,* 95*c* and 95*d* of sub-panel 90*c* are all positioned to be out of alignment with each other when the sub-panels 90*a–c* are in the assembled position for use when they overlie one another. The stitches of the first sub-panel 90*a,* the stitches of the second sub-panel 90*b,* and the stitches of the third sub-panel 90*c* are clearly spaced apart from each other when the sub-panels are assembled in the overlying position as depicted in FIG. 10. The stitches of each sub-panel are each spaced apart along the surface of their respective sub-panel. The nonalignment of the stitches from one panel to another does not provide any area of least resistance through the entire panel unlike that which would occur should the stitches be in alignment.

Figure 11:
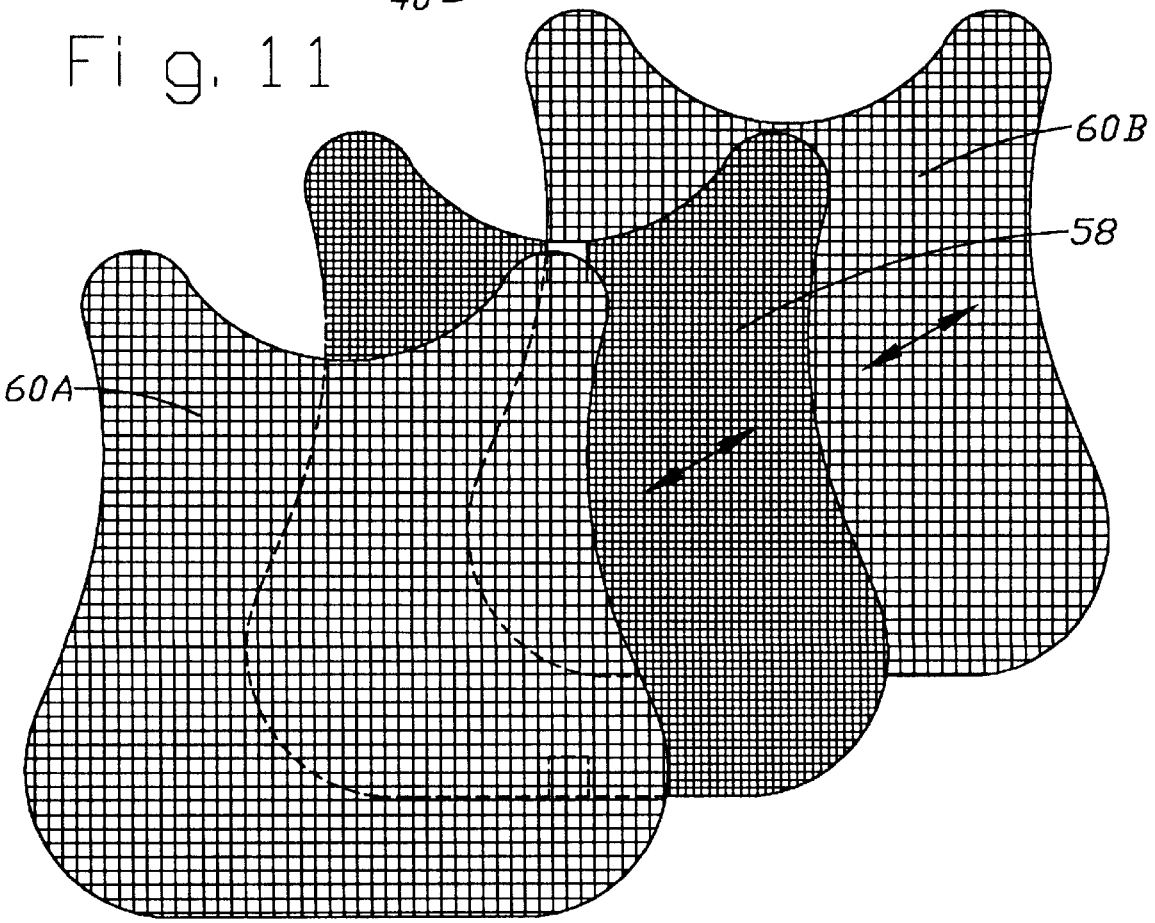
FIG. 11 is an exploded view of yet another embodiment of the present invention illustrating an uncovered puncture resistant sub-panel disposed between two uncovered ballistic resistant sub-panels.

Referring now to FIG. 11, another alternative embodiment of the present invention is shown illustrating three sub-panels 60A, 58 and 60B in which a puncture resistant panel 58 is positioned between a top or front ballistic resistant panel 60A and an underlying bottom or back ballistic resistant panel 60B. In this configuration a desired structure of the present invention is maintained by placing the bottom or back ballistic resistant panel 60B in a position where it will be closest to the body of the wearer. A key aspect of the present invention shown in the particular configuration of panels in FIG. 11 is accomplished by having the front ballistic panel 60A positioned at the strike face of the garment to receive the force of the impacting object. This sandwiched configuration of ballistic resistance, puncture resistance, ballistic resistance provides for added protection against a ballistic missile while also protecting the wearer against puncture or stabbing wounds from sharp attacking weapons. It has been found through testing that the garment performs more effectively with a puncture resistant panel 58 positioned behind a ballistic resistant panel as discussed above.

Another aspect of the present invention includes a method for assembling a puncture resistant garment. The preferred method of assembling such a puncture resistant garment is accomplished by the steps of: (1) assembling a plurality of woven sheets constructed of aramid fibers 24 to overlie one another in which the woven sheets 24 are constructed of aramid fibers in which said woven sheets have a weave of at least 60 aramid fibers per inch in one direction and at least 60 aramid fibers per inch in another direction which is transverse to the one direction and in which the aramid fibers have at least one of the following characteristics of: a) the aramid fibers being constructed of filaments which provide from 50,000,000 up to 90,000,000 filament crossovers per square inch in the plurality of woven sheets, b) the aramid fibers provide greater than 3 per cent of break elongation, and c) an individual aramid fiber provides greater than 23.8 grams per denier tenacity in order to prevent penetration of a sharp object through a puncture resistant panel formed from the woven sheets; and (2) securing the plurality of woven sheets 24 together forming the puncture resistant panel 28.

The preferred method includes the step of taping adjacent edges (FIGS. 3A, 3B) together of the woven sheets together. Alternatively, the adjacent edges of the woven sheets are selectively glued together. Securement of the woven sheets to form the puncture resistant panel includes the step of placing the plurality of woven sheets into a sleeve 26 constructed of moisture vapor permeable and water proof material and in which the sleeve has an interior shape and a dimension which is substantially the same as the shape and dimension of the plurality of woven sheets 22 which are inserted therein. A further approach to securing the individual woven sheets together to form a puncture resistant panel includes the step of stitching less than the total number of the woven sheets together by a line of stitches, 91A–91D, 93A–D, 95A–D which are positioned proximate to a side edge of the woven sheets thereby forming sub-panels 90A, 90B, 90C in position to overlie one another. As seen in FIG. 9, four lines of stitches are each positioned in lower right, lower left, upper right and upper left corner regions of the woven sheets to secure them together.

Preferably the aramid fiber which is woven into the layered sheets is no more than 200 denier. The aramid fiber used in the preferred embodiment is Kevlar® 159, however, other suitable fiber to be used preferably will have a tenacity of at least 27.0 grams/denier and a break elongation of at least 3.45%. The weave provided in the individual puncture resistant sheets in the panel 28 have at least sixty (60) warp ends 80 and at least sixty (60) fill ends 82 per inch, with a 70×70 aramid fibers per inch balanced weave optimally being employed, FIG. 7A. Alternatively, as seen in FIG. 7B the warp 84 and fill ends 86 of the aramid fibers forming the puncture resistant panel are selectively imbalanced in number whereby the warp ends of the aramid fibers exceed the number of fill ends of the aramid fiber.

The method of forming a puncture resistant vest includes the step of positioning a ballistic resistant panel on top of the puncture resistant panel in which the ballistic resistant panel is selectively constructed of a woven fiber having filaments with fewer than 60 warp ends and fill ends per inch while also having generously more than 90,000,000 filament crossovers per square inch for the fibers of the ballistic resistant panel. An unwoven composite material formed of a metallic sheet member, a ceramic or titanium composite material or Gold Flex® material maybe alternatively employed which is positioned to overlie the puncture resistant panel and/or woven ballistic panel to prevent penetration of a ballistic missile through the ballistic resistant panel.

In another arrangement of the garment of the present invention, two puncture resistant panels are selectively positioned to each overlie both sides of the ballistic resistant panel 60 thereby positioning the ballistic resistant panel between the two puncture resistant panels. An alternative embodiment, as seen in FIG. 4, the ballistic resistant panel 60 is positioned at a strike face of the garment.

While a detailed description of the preferred embodiments of the invention has been given, it should be appreciated that many variations can be made thereto without departing from the scope of the invention as set forth in the appended claims.

What is claimed is:

1. A puncture resistant garment, comprising:

a plurality of flexible layers of woven sheets positioned to overlie one another forming a puncture resistant panel, in which a less than a total number of the plurality of sheets are secured together to form a sub-panel within said puncture resistant panel with said plurality of woven sheets being constructed of aramid fibers in which said woven sheets have a weave of at least 60 aramid fibers per inch in a direction and at least 60 aramid fibers per inch in another direction transverse to said direction and in which said aramid fibers have at least one of the following characteristics of: a) said aramid fibers are constructed of filaments which provide from 50,000,000 up to 90,000,000 filament crossovers per square inch in said plurality of woven sheets, b) said aramid fibers have a break elongation of greater than 3 percent and c) said aramid fibers provide greater than 23.8 grams per denier tenacity preventing penetration of said puncture resistant panel with a sharp object; and a ballistic resistant panel constructed of at least one of: a) woven fiber having less than 60 warp ends and less than 60 fill ends per inch of the woven fiber and in which the woven fiber is constructed of filaments having greater than 90,000,000 filament crossovers per square inch of said ballistic resistant panel, and b) composite material, positioned to overlie said puncture resistant panel to prevent penetration of a ballistic missile through said garment.

2. The puncture resistant garment of claim 1 in which said less than the total number of the plurality of sheets are secured together with stitches.

3. The puncture resistant garment of claim 2 in which said stitches are formed of an aramid fiber.

4. The puncture resistant garment of claim 2 in which said stitches include four separate lines of stitches in which one of said lines is each positioned in a lower right, lower left, upper right and upper left portion of said sub-panel relative to a central portion of said sub-panel having fewer woven sheets than the total number of woven sheets.

5. The puncture resistant garment of claim 4 in which each line of stitches is spaced apart from an edge of said sheets and is also positioned closer to said edge of one of said sheets than to the central portion of the sheet.

6. The puncture resistant garment of claim 4 including at least two sub-panels in which said stitches of a first sub-panel are positioned out of alignment with said stitches of a second sub-panel in which the sub-panels are positioned to overlie one another.

7. The puncture resistant garment of claim 6 in which said stitches of said first sub-panel and of said second sub-panel and are spaced apart from one another along said first and second sub-panels upon the first and second sub-panels being placed in an overlying position.

8. The puncture resistant garment of claim 1 in which each of the sheets have edges and in which said edges of each of said plurality of sheets are congruent with one another within said panel.

9. A puncture resistant garment, comprising:

two puncture resistant panels in which the puncture resistant panels are formed of a plurality of flexible layers of woven sheets positioned to overlie one another, in which said plurality of woven sheets are constructed of aramid fibers in which said woven sheets have a weave of at least 60 aramid fibers per inch in a direction and at least 60 aramid fibers per inch in another direction transverse to said direction and in which said aramid fibers have at least one of the following characteristics of: a) said aramid fibers are constructed of filaments which provide from 50,000,000 up to 90,000,000 filament crossovers per square inch in said plurality of woven sheets, b) said aramid fibers have a break elongation of greater than 3 percent and c) said aramid fibers provide greater than 23.8 grams per denier tenacity preventing penetration of said puncture resistant panels with a sharp object; and a ballistic resistant panel constructed of at least one of: a) woven fiber having less than 60 warp ends and less than 60 fill ends per inch of the woven fiber and in which the woven fiber is constructed of filaments having greater than 90,000,000 filament crossovers per square inch of said ballistic resistant panel, and b) composite material, positioned to overlie said puncture resistant panel to prevent penetration of a ballistic missile through said garment and in which said ballistic resistant panel is positioned between said two puncture resistant panels.

10. A puncture resistant garment, comprising:

a plurality of flexible layers of woven sheets positioned to overlie one another forming a puncture resistant panel, in which said plurality of woven sheets are constructed of aramid fibers in which said woven sheets have a weave of at least 60 aramid fibers per inch fibers in a direction and at least 60 aramid fibers per inch in another direction transverse to said direction and in which said aramid fibers have at least one of the following characteristics of: a) said aramid fibers are constructed of filaments which provide from 50,000,000 up to 90,000,000 filament crossovers per square inch in said plurality of woven sheets, b) said aramid fibers have a break elongation of greater than 3 percent and c) said aramid fibers provide greater than 23.8 grams per denier tenacity preventing penetration of said puncture resistant panel with a sharp object; and a ballistic resistant panel constructed of at least one of: a) woven fiber having less than 60 warp ends and less than 60 fill ends per inch of the woven fiber and in which the woven fiber is constructed of filaments having greater than 90,000,000 filament crossovers per square inch of said ballistic resistant panel, and b) composite material, positioned to overlie said puncture resistant panel to prevent penetration of a ballistic missile through said garment and, in which said ballistic resistant panel is positioned at a strike face of said garment.

11. A puncture resistant garment comprising:

a plurality of flexible layers of woven sheets positioned to overlie one another forming a puncture resistant panel, in which said plurality of woven sheets are constructed of aramid fibers in which said woven sheets have a weave of at least 60 aramid fibers per inch in a direction and at least 60 aramid fibers per inch in another direction transverse to said direction and in which said aramid fibers have at least one of the following characteristics of: a) said aramid fibers are constructed of filaments which provide from 50,000,000 up to 90,000,000 filament crossovers per square inch in said plurality of woven sheets, b) said aramid fibers have a break elongation of greater than 3 percent and c) said aramid fibers provide greater than 23.8 grams per denier tenacity preventing penetration of said puncture resistant panel with a sharp object; and a ballistic resistant panel constructed of at least one of a) a plurality of sheets of woven aramid fiber having less than 60 warp ends and less than 60 fill ends per inch of the woven fiber and in which the woven fiber has a denier greater than 200 denier and is constructed of filaments having greater than 90,000,000 filament crossovers per square inch in said ballistic resistant panel, and b) composite material, and in which said ballistic resistant panel is positioned to overlie said puncture resistant panel to prevent penetration of a ballistic missile through said garment.

12. A puncture resistant garment, comprising:

a plurality of flexible layers of woven sheets positioned to overlie one another forming a puncture resistant panel, in which said plurality of woven sheets are constructed of aramid fibers in which said woven sheets have a weave of at least 60 aramid fibers per inch in a direction and at least 60 aramid fibers per inch in another direction transverse to said direction and in which said aramid fibers have at least one of the following characteristics of: a) said aramid fibers are constructed of filaments which provide from 50,000,000 up to 90,000,000 filament crossovers per square inch in said plurality of woven sheets, b) said aramid fibers have a break elongation of greater than 3 percent and c) said aramid fibers provide greater than 23.8 grams per denier tenacity preventing penetration of said puncture resistant panel with a sharp object, and a ballistic resistant panel constructed of at least one of: a) woven fiber having less than 60 warp ends and less than 60 fill ends per inch of the woven fiber and in which the woven fiber is constructed of filaments having greater than 90,000,000 filament crossovers per square inch of said ballistic resistant panel, and b) composite material including a metallic sheet member, positioned to overlie said puncture resistant panel to prevent penetration of a ballistic missile through said garment.

13. The puncture resistant garment of claim 12 in which said composite of said ballistic resistant panel includes reinforced plastic material.

14. A puncture resistant garment, comprising:

a plurality of flexible layers of woven sheets positioned to overlie one another forming a puncture resistant panel, in which said plurality of woven sheets are constructed of aramid fibers in which said woven sheets have a weave of at least 60 aramid fibers per inch in a direction and at least 60 aramid fibers per inch in another direction transverse to said direction and in which said aramid fibers are constructed of filaments which provide from 50,000,000 up to 90,000,000 filament crossovers per square inch in said plurality of woven sheets to prevent penetration of the puncture resistant panel with a sharp object; and a ballistic resistant panel constructed of woven fiber constructed of filaments having greater than 90,000,000 filament crossovers per square inch and in which the ballistic resistant panel has less than 60 warp ends and less than 60 fill ends per inch of the woven fiber.

15. A puncture resistant garment, comprising:

a plurality of flexible layers of woven sheets positioned to overlie one another forming a puncture resistant panel, in which said plurality of woven sheets are constructed of aramid fibers in which said woven sheets have a weave of at least 60 aramid fibers per inch in a direction and at least 60 aramid fibers per inch in another direction transverse to said direction and in which said aramid fibers have a break elongation greater than 3 per cent to prevent penetration of the puncture resistant panel with a sharp object; and a ballistic resistant panel constructed of woven fiber constructed of filaments having greater than 90,000,000 filament crossovers per square inch and in which the ballistic resistant panel has less than 60 warp ends and less than 60 fill ends per inch of the woven fiber.

16. A puncture resistant garment, comprising:

a plurality of flexible layers of woven sheets positioned to overlie one another forming a puncture resistant panel, in which said plurality of woven sheets are constructed of aramid fibers in which said woven sheets have a weave of at least 60 aramid fibers per inch in a direction and at least 60 aramid fibers per inch in another direction transverse to said direction and in which said aramid fibers provide greater than 23.8 grams per denier tenacity preventing penetration of said puncture resistant panel with a sharp object; and a ballistic resistant panel constructed of woven fiber constructed of filaments having greater than 90,000,000 filament crossovers per square inch and in which said ballistic resistant panel has less than 60 warp ends and less than 60 fill ends per inch of the woven fiber.

* * * * *